United States Patent [19]

Paterra et al.

[11] Patent Number: 5,005,996

[45] Date of Patent: Apr. 9, 1991

[54] RIBBON CARTRIDGE WITH ENDLESS RIBBON REINKING MECHANISM

[75] Inventors: Jeffrey H. Paterra, Charlotte, N.C.; Donald K. Rex, Highland Beach, Fla.

[73] Assignee: International Business Machines Corporation, Armonk, N.Y.

[21] Appl. No.: 408,017

[22] Filed: Sep. 15, 1989

[51] Int. Cl.[5] ..... B41J 32/00

[52] U.S. Cl. ..... 400/196.1; 400/202.4; 400/208

[58] Field of Search ..... 400/196.1, 196, 197, 400/204, 202, 202.1, 202.2, 202.4, 208, 208.1

[56] References Cited

U.S. PATENT DOCUMENTS

| | | | |
|---|---|---|---|
| 4,091,914 | 5/1978 | Stipanuk | 400/196.1 |
| 4,449,838 | 5/1984 | Okamura et al. | 400/202.4 |
| 4,536,098 | 8/1985 | Sheehan et al. | 400/196.1 |
| 4,616,942 | 10/1986 | Nagasawa et al. | 400/196.1 |
| 4,632,583 | 12/1986 | Nash | 400/196.1 |
| 4,636,097 | 1/1987 | Goubeaux | 400/202.4 |
| 4,650,354 | 3/1987 | Morarka | 400/196.1 |
| 4,653,947 | 3/1987 | Echols | 400/196.1 |
| 4,712,932 | 12/1987 | Morita | 400/196.1 |
| 4,747,713 | 5/1988 | Kikuchi et al. | 400/202.4 |
| 4,913,571 | 4/1990 | Bulson et al. | 400/196.1 |

*Primary Examiner*—Eugene H. Eickholt
*Attorney, Agent, or Firm*—John Robert Hanway

[57] ABSTRACT

A ribbon cartridge for an endless ribbon used in high speed printers, with increased reliability due to fewer parts, is constructed from a molded casing which is rectangular in shape into which are formed a post on which a cylindrical porous ink reservoir is mounted, a ribbon protector which isolates the ink reservoir from the ribbon in the stuffer box portion of the cartridge, and a forked bracket for mounting a shaft on which gears are mounted. A combination gear for driving a ribbon into the stuffer box and for re-inking the ribbon is mounted on a post and then rotatably mounted on the bracket formed into the housing and is inked by contact with the ink reservoir. An idler gear is rotatably mounted on a bracket which is pivoted from a socket molded into the socket wall and is spring biased into contact with the drive and transfer gear, which is turned by its extended shaft advance and ink the ribbon. As a result a simplified re-inking arrangement is achieved with the minimum of components. Also, by re-inking a central drive and transfer gear, only the print track of a ribbon is reinked thereby extending the re-inking life by conserving ink.

15 Claims, 4 Drawing Sheets

4
20
18
22
16
2
14
12
10

Fig. 4
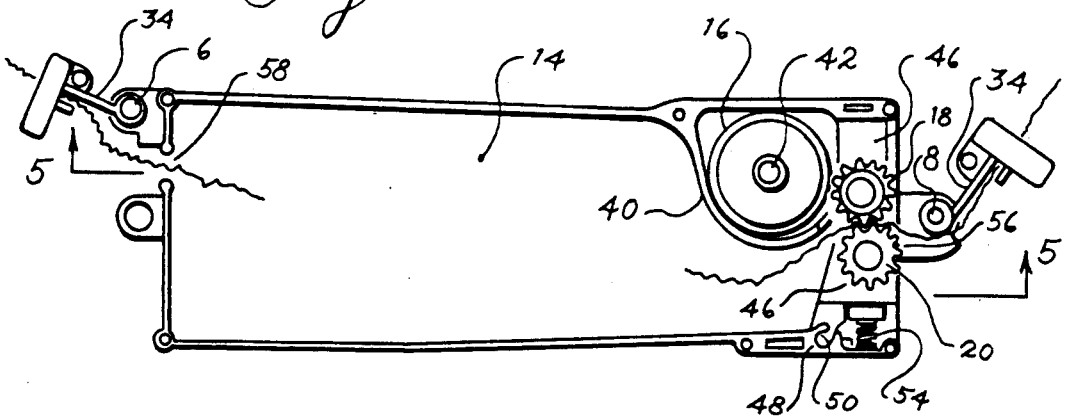
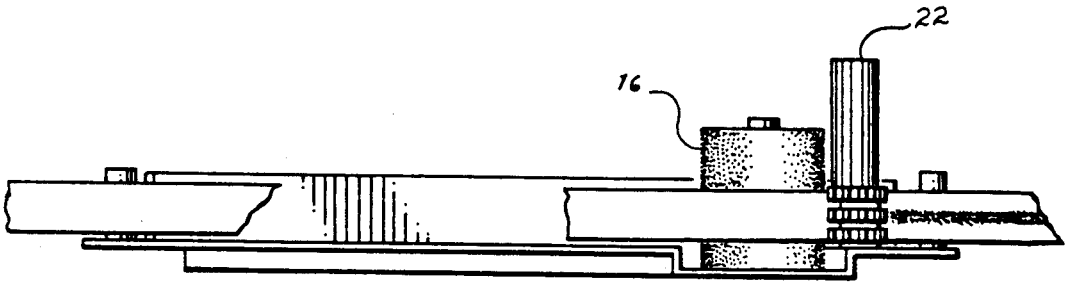
Fig. 5
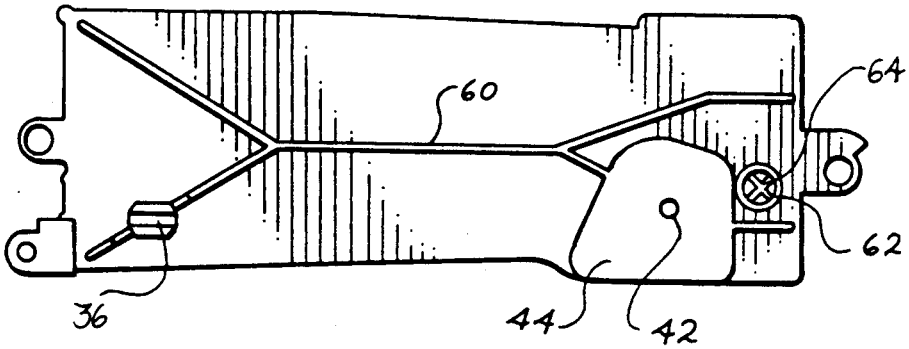
Fig. 6

RIBBON CARTRIDGE WITH ENDLESS RIBBON REINKING MECHANISM

TECHNICAL FIELD

This invention relates to the ribbon cartridges for endless ribbons and the re-inking mechanism housed therein. Porous ink reservoirs have been used to re-ink print ribbons in stuffer box cartridges in varying configurations. In this invention a simplified design for re-inking endless ribbons incorporates a porous ink reservoir which transfers ink to a combination drive-transfer gear and a pinch gear to cooperate with the drive-transfer gear to advance a ribbon and re-ink it.

BACKGROUND ART

With the advent of high speed printing, ribbon life became a problem. A solution is to continuously reuse ribbons by re-inking them, resulting in extended life. Re-inking is achieved by various techniques including using wicks supplied by an ink reservoir to apply ink to a ribbon surface. Another method of re-inking is to pass a ribbon against a porous ink reservoir and yet another method is to ink a roller from an ink reservoir and transfer the ink to the ribbon.

In U.S. Pat. No. 4,616,942, Nagasawa et al. a ribbon cassette, with re-inking mechanism, is shown in which a removable ink supply is mounted within the cassette and a first roller is inked by contact with the ink supply and a second roller is pivotally mounted to engage a ribbon between it and the first roller to advance a ribbon into the cavity of the cassette and re-ink it. The second roller is mounted on a pivot arm and has a drive gear for rotating it and thereby advancing the ribbon. The pivot arm is biased to affect the cooperative engagement of the first and second rollers.

In U.S. Pat. No. 4,636,097, Goubeaux, there is shown in a cartridge for an endless ribbon, an ink reservoir in the form of a transfer roller pivotally mounted and spring biased into engagement with a transfer roller for re-inking the transfer roller which is pivotally mounted on a fixed post affixed to the housing of the cartridge. A second roller is spring biased to pinch a ribbon between it and the transfer roller. An external drive mechanism engages the transfer roller to drive it and advance the ribbon.

In U.S. Pat. No. 4,653,947, Echols, a re-inking device for an endless ribbon is taught in which a cartridge has a rotatable ink reservoir mounted within a case and a transfer roller likewise mounted within this case which is in contact for re-inking and the transfer roller is exposed through an opening in the case to contact a ribbon driven between it and a second roller on a fixed posted which is driven by an external means to advance the pair of rollers and the ribbon. The contact between the rollers to grasp and advance the ribbon is achieved by pivotally mounting the case within the cartridge and spring biasing it toward the stationary roller.

Applicants having pending an application for Patent, filed May 30, 1989 in the U.S. Patent and Trademark Office which disclose and claims a ribbon re-inking device which incorporates a combination drive-transfer gear which cooperates with a rotatable porous ink reservoir body to transfer ink to the print track of a reusable ribbon. The mechanism has a toothed gear biased into engagement with the drive-transfer gear to grasp a ribbon therebetween and by rotation of the drive-transfer gear advance the ribbon and re-ink the print track of a ribbon.

SUMMARY OF THE INVENTION

The invention provides a simplified construction for a ribbon cartridge for an endless ribbon which may be molded into a one piece housing with molded integral components to simplify construction. Molded into the housing is a post on which is mounted a barrel shaped porous ink reservoir which is the source of ink for the re-inking process. Partially surrounding the ink reservoir is a ribbon protector which isolates the ink reservoir from a ribbon stuffed into the cavity of the ribbon cartridge housing. This ink reservoir has a raised circumference which transfers ink by contact to one or more of a stack of drive and transfer gears which in turn are rotatably mounted in a stationary bracket molded into the housing. In practice, only one gear in a stack of gears is inked so that it alone transfers ink to the print track of and endless ribbon. The ribbon is interposed between the drive and transfer gear and a second idler gear which is rotatably mounted on a bracket which pivots on a socket in the housing and has a spring for urging the idler gear into engagement with the drive and transfer gear.

Extending from the stack of drive and transfer gears is a shaft which extends beyond the ribbon cartridge housing and which is splined so that it can be engaged manually or mechanically to rotate the drive-transfer gear. When the drive-transfer gear is rotated clockwise in engagement with the idler gear, ribbon is drawn into the housing cavity of the ribbon cartridge in what is known as a stuffer box. In the process of drawing the ribbon in, the central gear on the drive-transfer gears transfers ink to the print track of the ribbon.

A recessed end of the shaft on which the drive and transfer gears are exposed through the bottom of the cartridge housing to allow a motor driven shaft to be inserted to rotate the drive and transfer gears.

Accordingly, it is an object of this invention to provide a simplified construction of a ribbon cartridge by minimizing the number of parts and forming many of the components into the molded housing to reduce the number of components of a re-inking system.

Yet another object of this invention is the construction of a simplified ribbon re-inking system which is economical to construct and has incorporated a re-inking apparatus which has an extended re-inking life.

Still another object of this invention is to construct a simplified ribbon re-inking system which has a high degree of reliability resulting from fewer parts.

BRIEF DESCRIPTION OF THE DRAWINGS

FIG. 4 shows a plan view of an endless ribbon cartridge without the ribbon in the stuffing box.

FIG. 5 shows a cross section of an endless ribbon cartridge along section lines A-A as shown in FIG. 4.

FIG. 6 shows the bottom view of an endless ribbon cartridge.

DESCRIPTION OF THE INVENTION

Figure 1:
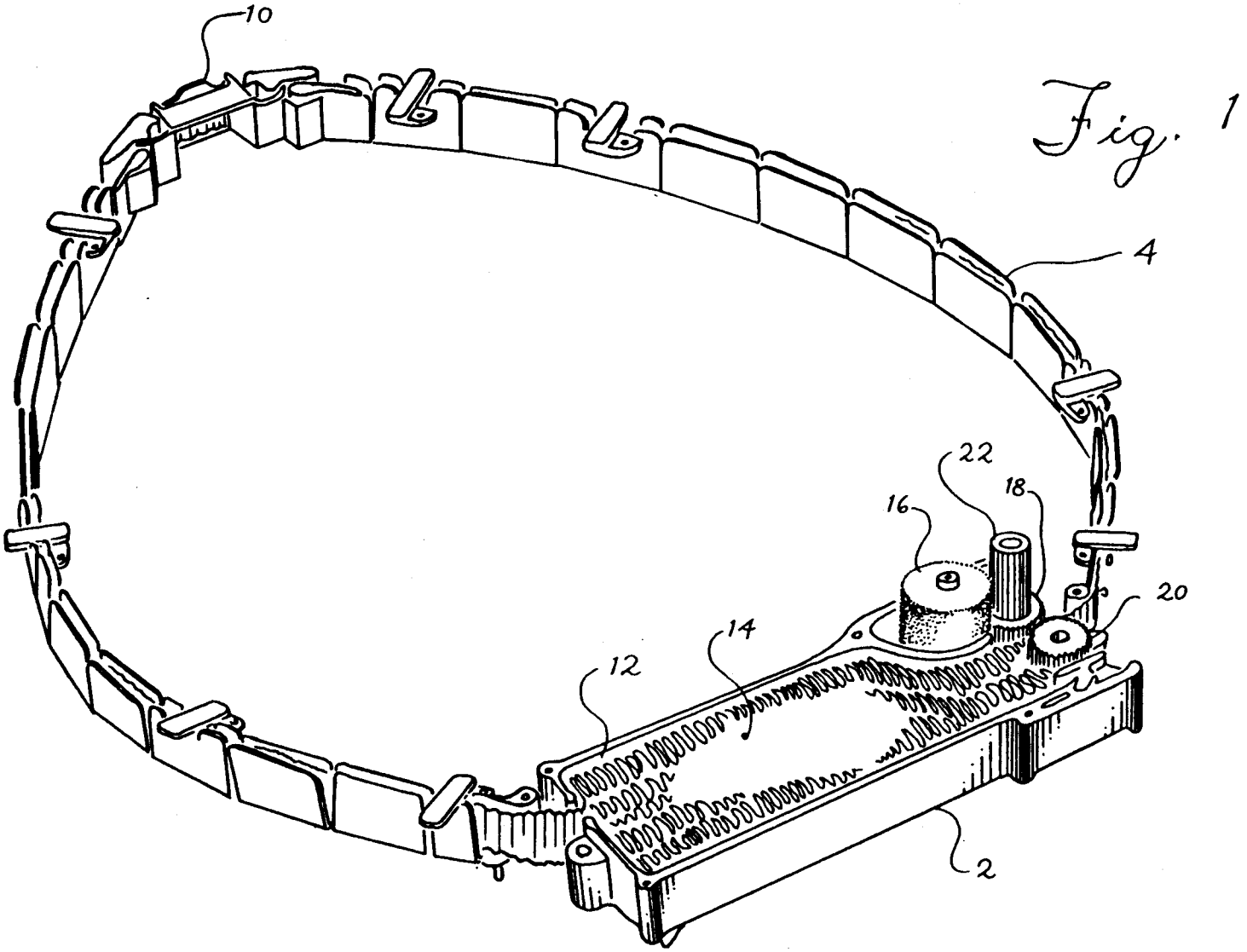
FIG. 1 shows a three dimensional view of an endless ribbon cartridge and flexible ribbon guide.

Shown in FIG. 1 is a three dimensional view of a ribbon cartridge 2, with a flexible ribbon guide 4 pivotally attached to the ribbon cartridge 2 at posts 6 and 8, shown in FIG. 4, which are integrally formed as part of the ribbon cartridge 2. The flexible ribbon guide 4, is constructed to adapt to a printer with a movable print head at the ribbon shield 10. This invention is not dependent upon the use of a flexible ribbon guide as a means of delivering a ribbon to a print head for printing but is shown as a conventional use of the ribbon cartridge of this invention.

Also shown in FIG. 1 is the contents of the ribbon cartridge 2, which includes an endless ribbon 12 stuffed into the cavity 14 of the ribbon cartridge 2 in a conventional ribbon stuffing box configuration. A re-inking apparatus is positioned at one end of ribbon cartridge 2 and includes a cylindrical ink reservoir 16, rotatably mounted, a drive-transfer gear 18 which receives ink from ink reservoir 16, and transfers ink to an endless ribbon 12 by engaging the ribbon 12 between the drive-transfer gear 18 and a spring biased idler gear 20. An external motor can drive the splined shaft 22 which extends from the drive-transfer gear 18 to advance the endless ribbon 12 into the cavity 14 and to simultaneously re-ink it, or it can be turned manually to rotate the drive-transfer gear 18, which is the embodiment shown.

Figure 2:
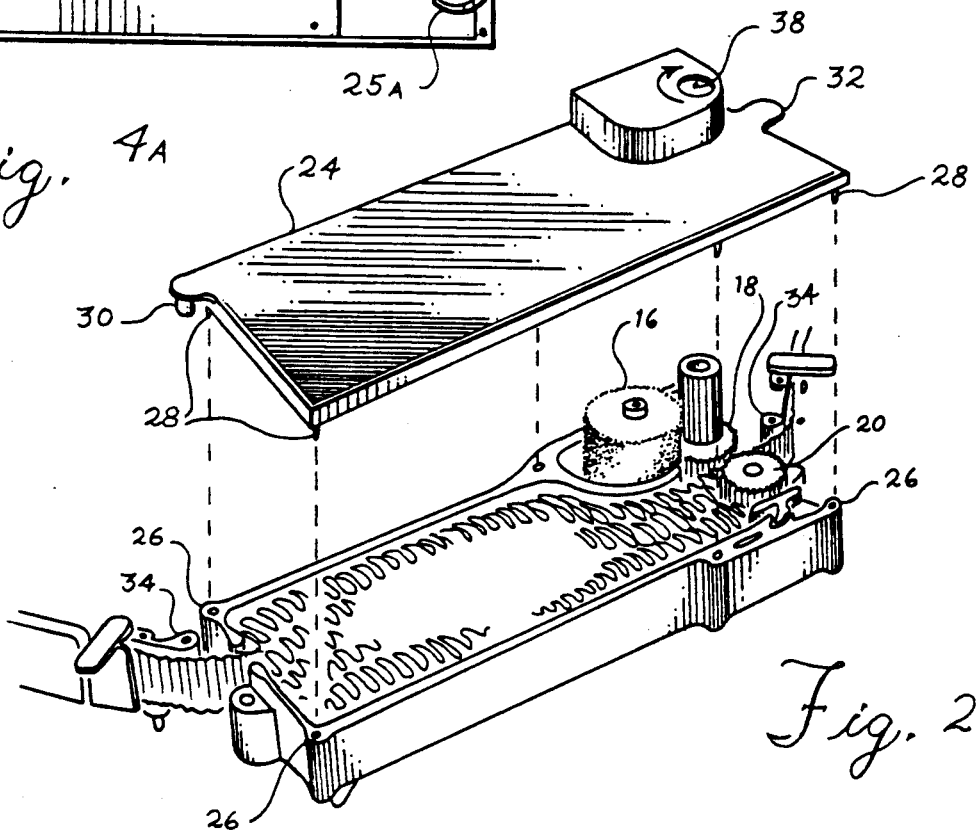
FIG. 2 shows a view of and endless ribbon cartridge with its cover removed.

Shown in FIG. 2 is a three dimensional view of the ribbon cartridge 2 with a cover 24 positioned over the ribbon cartridge 2. At the corners of ribbon cartridge 2 are pin receivers 26 which accept pins 28 when the cover 24 is mated with the ribbon cartridge 2. The cover 24 has a second set of posts 30 and 32 molded onto it which are in axial alignment with the posts 6 and 8 molded onto ribbon cartridge 2 so that when the cover 24 is joined to the ribbon cartridge 2, posts 6 and 8 and 30 and 32, respectively are in axial alignment and hold between them bored bearing arms 34 which is the terminus of flexible ribbon guide 4 which allows the pivotal motion of the flexible ribbon guide as it moves with a print head motion, thereby allowing the ribbon cartridge to be affixed to a printer by mounting means well known in the art but which is here described as a tab 36 molded onto the ribbon cartridge 2, as shown in FIG. 6.

Figure 4A:
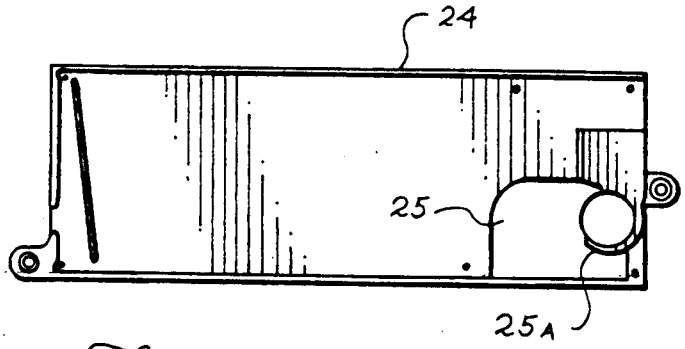
FIG. 4A shows a bottom view of the ribbon cartridge cover.

In FIG. 4A, on the cover 24, there is shown a recessed section 25 which covers ink reservoir 16, and raised portion 25A which holds drive-transfer gear 18 in place when the cover 24 is sealed onto the ribbon cartridge. Cover 24 has an opening 38 through which a splined shaft 22, extends to be turned in a clockwise direction to advance the endless ribbon 12 into the cavity 14.

Figure 3:
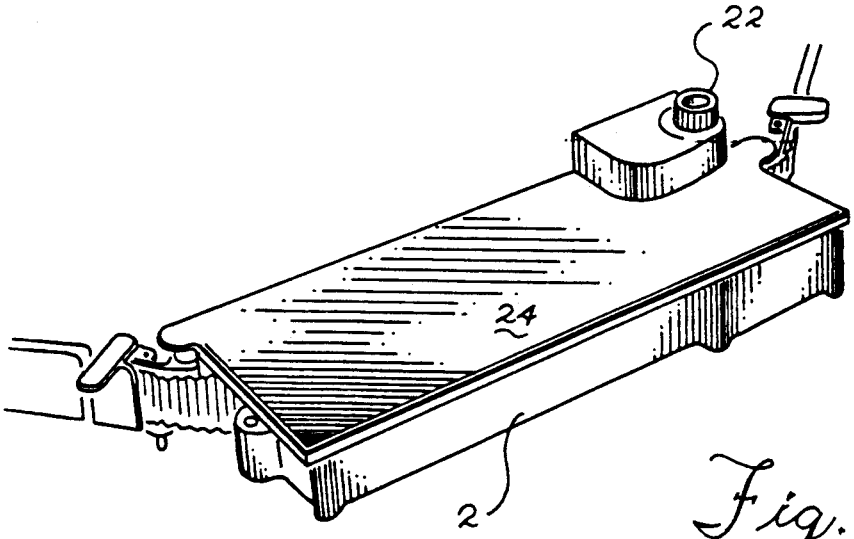
FIG. 3 shows an external view of an endless ribbon cartridge.

Shown in FIG. 3 is the ribbon cartridge 2 with the cover 24 attached by known means which include adhesives, heat fusing and mechanical attachments such as frictional contact between pins 26 and pin receivers 28. Splined shaft 22 extends from the opening 38 (see FIG. 2) on cover 24 when it is in place to allow splined shaft 22 to be acted upon by an external force to rotate drive-transfer gear 18.

FIG. 4 is a top view of the ribbon cartridge 2 without ribbon to more clearly show the operating mechanism. A ribbon protector 40 is molded onto the ribbon cartridge 2 to partially encircle the ink reservoir 16 and separate it from the cavity 14 where the endless ribbon 12 is stored. It can be seen from this view that ink reservoir 16 is rotatably mounted on a post 42 which is molded into the bottom 44 of the ribbon cartridge 2 shown in FIG. 5. FIG. 6, a bottom view of the ribbon cartridge 2, shows the configuration of the bottom 44 and particularly the post 42 attached thereto, on which the ink reservoir 16 rotates. Also shown in FIG. 4 is the relationship of drive-transfer gear 18 mounted on bracket 46 which is forked (as more clearly seen in FIGS. 8 and 9) in this embodiment and is molded onto the ribbon cartridge 2 side. The relationship of drive-transfer gear 18 and ink reservoir 16 is such that they rotate in contact near a point where the ribbon protector 40 terminates, thereby transferring ink to the drive-transfer gear 18 as the two rotate in frictional contact. The idler gear 20 is shown mounted on a second bracket 48 which is pivotally mounted in a socket 50 by a rounded arm 52. A spring 54 is interposed between this second bracket 48 and the side of the ribbon cartridge 2 to bias the idler gear 20 into engagement with the drive-transfer gear 18 for grasping the endless ribbon 12 therebetween.

In FIG. 5 there is shown a cross section of the ribbon cartridge 2 along section lines A—A of FIG. 4, which gives a view of the drive-transfer gear 18 in relation to ink reservoir 16 with an extended splined shaft 22 (shown in FIGS. 5 and 8) extending upward through the ribbon cartridge. Finger rotation of this splined shaft will advance the endless ribbon 12 into the ribbon cartridge 2 cavity 14. This view shows the endless ribbon entering the ribbon cartridge 2 cavity 14 at opening 56 and exiting at opening 58 as more clearly shown in FIG. 4.

Figure 8:
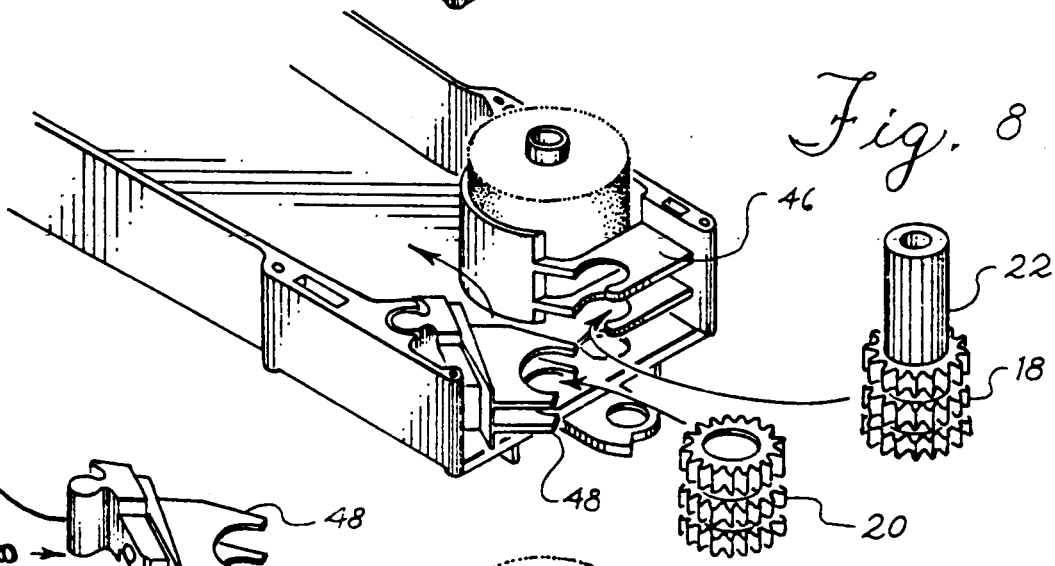
FIG. 8 shows a partially disassembled ribbon re-inking mechanism in an endless ribbon cartridge.

FIG. 6 is a bottom view of the ribbon cartridge and shows the support braces 60 molded into the ribbon cartridge and a circular hole 62 through which is accessed the bored out end 64 of the shaft 22 shown in FIG. 8 on which the drive-transfer gears are mounted. There is a relieved surface in the end of the bored out end 64 which in this instance is cross shaped to receive a drive shaft (not shown) with a cross shaped head for driving the shaft 22 and thereby turning the drive-transfer gear 18. An external motor will drive the shaft 22.

Figure 9:
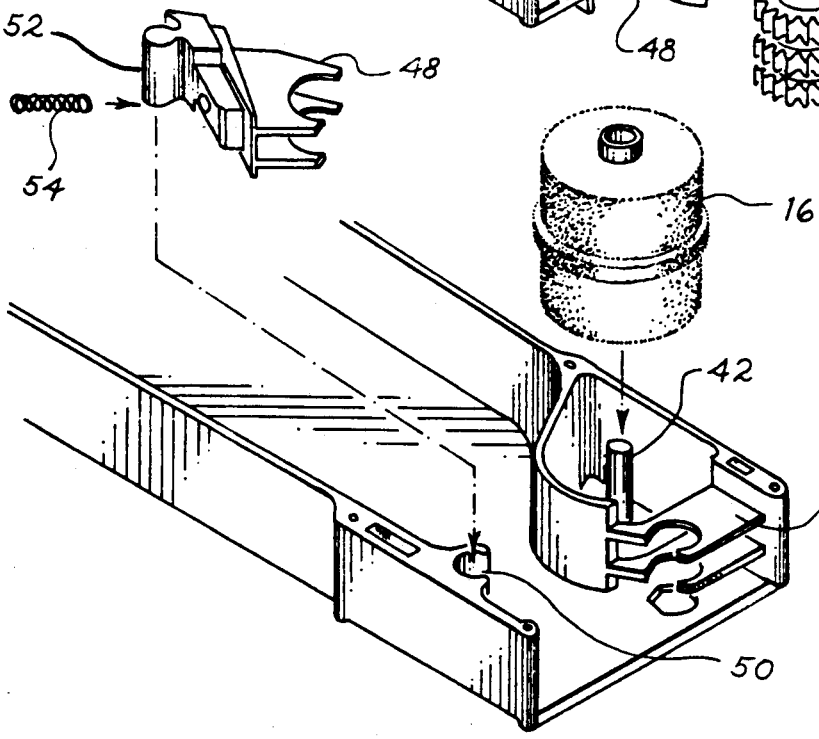
FIG. 9 shows another stage in a partially disassembled ribbon re-inking mechanism in an endless ribbon cartridge.

FIGS. 8 and 9 show the disassembled drive-transfer gear 18, the idler gear 20 and the pivoting bracket 48 and particularly the forked shape of the brackets 46 and 48 to show how the drive-transfer gear 18 and idler gear 20 have three sets of, gears allowing them to slide into the forks of brackets 46 and 48 for mounting on the rounded ends of the forks on the brackets 46 and 48. In FIG. 9, ink reservoir 16 is shown disassembled in relation to the post 42 onto which the ink reservoir 16 is positioned. Also in FIG. 9, the socket 50 molded into the side of ribbon cartridge 2 is shown and a disassembled pivoting bracket 48 is shown.

Figure 7:
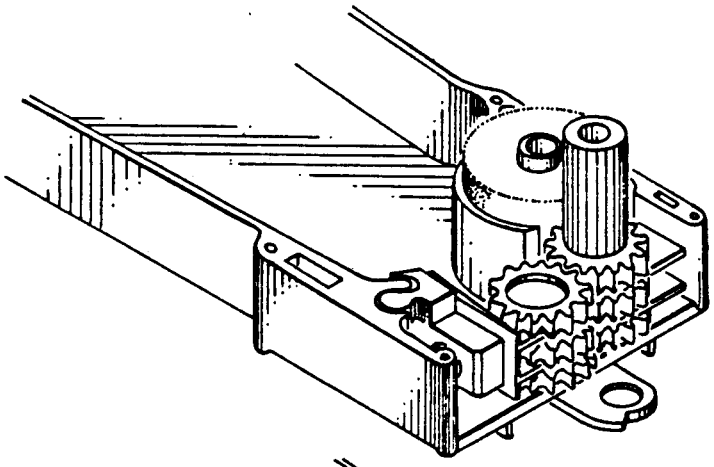
FIG. 7 shows a three dimensional view of a ribbon re-inking mechanism in an endless ribbon cartridge.

FIG. 7 shows the general relationship of the re-inking apparatus in the ribbon cartridge 2 and the simplicity of this design. It will also be apparent to those skilled in the art of ribbon cartridge design that various changes can be made in this design without departing from the spirit and scope of the invention. It comes to mind that one variation is a different external configuration of the ribbon cartridge 2, which would not effect the efficient design of the re-inking apparatus configured within.

What is claimed is:

1. A ribbon cartridge comprising;

a one piece housing having a cavity within defined by sides and a bottom having formed thereon a post, a ribbon protector partially surrounding said post, a socket formed on a side of said housing, a bracket formed on yet another side of said housing, said bracket formed to provide a bearing surface for a rotating shaft, a porous ink reservoir having an external circumference defined by points of rotation about an axis and having a central bore for rotatably mounting on said post, a combination ink transfer and drive gear having a central shaft, said central shaft rotatably mounted on said bracket, said ink transfer and drive gear mounted in frictional contact with the external circumference of said ink reservoir, said ink transfer and drive gear further having a splined shaft extending beyond said gear in axial alignment with the axis of rotation of said central shaft, said central shaft having a bored out center in the end opposite said splined shaft, a circular opening in said housing bottom centered on said central shaft bored end for exposing said bored end through said housing bottom, a toothed idler gear pivotally mounted in said socket on said housing and biased into engagement with said drive gear for engaging a ribbon therebetween, and a cover for enclosing said housing, having a hole therein for exposing said splined shaft of said drive transfer gear beyond said cover.

2. A ribbon cartridge according to claim 1, wherein said bore of said central shaft has a circular circumference, and the end of said bore is relieved to receive a contoured drive shaft.

3. A ribbon cartridge according to claim 1, wherein said bore of said central shaft is splined.

4. A ribbon cartridge according to claim 1, further comprising a means for rotating said central shaft of said drive gear to thereby advance a ribbon into said cavity of said housing.

5. A ribbon cartridge according to claim 1, further comprising a flexible ribbon guide attached to said housing for guiding a ribbon into said cavity of said housing and receiving a ribbon discharged from the cavity of said housing.

6. A ribbon cartridge comprising;

a housing having a cavity defined by sides and a bottom portion for containing a ribbon, having a first opening for receiving a ribbon and a second opening for discharging a ribbon, a cover for sealing said housing having a circular hole therein, a post mounted on said housing, a porous fluid reservoir having an exterior circumference defined by equal points of rotation about an axis, said reservoir having a central bore for mounting on said post, a ribbon protector partially surrounding said porous fluid reservoir to separate said fluid reservoir from a ribbon in said housing cavity, a bracket affixed to said housing for holding a shaft, a toothed drive-transfer gear having a central shaft rotatably mounted on said bracket, the exterior circumference of said gear being in frictional contact with the exterior circumference of said fluid reservoir, said central shaft further having one end bored out, and the opposite end having a length extended beyond said gear, a circular opening in said housing bottom portion centered to expose said bored out end of said central shaft, and a toothed idler gear, pivotally mounted within said housing and biased into engagement with said toothed drive-transfer gear for engaging said ribbon therebetween.

7. A ribbon cartridge according to claim 6 wherein said extended shaft of said drive-transfer gear is splined.

8. A ribbon cartridge according to claim 6 wherein said ribbon cartridge housing, said ribbon protector, post and bracket are molded in one piece.

9. A ribbon cartridge according to claim 6 further comprising a flexible ribbon guide attached to said housing for feeding ribbon into said first opening and receiving discharged ribbon from said second opening.

10. A ribbon cartridge comprising:

a one piece molded housing forming a cavity having a generally rectangular shape with sides and a bottom, said housing having a first opening for receiving a ribbon and a second opening for discharging a ribbon, said housing having molded thereon a post, a ribbon protector partially enclosing said post, a first bracket having a bearing surface for mounting a rotatable body, and a socket, an ink reservoir whose exterior surface is defined by points of rotation about an axis, having a raised circumferential surface, said reservoir having a central circular bore for rotatable mounting on said post, a drive-transfer gear having multiple sets of gears fixedly mounted in axial alignment on a shaft and having a portion of said shaft extended beyond said drive-transfer gear, said drive-transfer gear rotatably mounted on said first bracket in frictional contact with the raised circumferential surface of said ink reservoir, said drive-transfer gear further having a bored out end opposite said extended portion of said shaft, a circular opening on said housing bottom centered on said circular bore of said central shaft for exposing said circular bore through said housing, a second bracket having an arm with a pivot surface, said second bracket having its pivot surface resting in and rotating in said socket, said second bracket further having a bearing surface for mounting a rotatable body, an idler gear rotatably mounted on said second bracket, in proximity to said drive-transfer gear, means to urge said idler gear mounted on said second bracket into engagement with said drive-transfer gear for grasping a ribbon therebetween, a housing cover, conforming to the open side of said housing for sealing the cavity in said housing, said housing cover having a hole therein for said extended shaft on said drive-transfer gear to extend beyond said housing cover, and a flexible ribbon guide attached to said housing for guiding a ribbon into the first opening of said housing for receiving said ribbon and a second opening for receiving a ribbon discharged from said housing cavity.

11. A ribbon cartridge according to claim 10, further comprising a means to rotate said shaft on said drive-transfer gear for advancing the ribbon engaged between said drive-transfer gear and said idler gear.

12. A ribbon cartridge according to claim 10, wherein said shaft extending from said drive-transfer gear is splined.

13. A ribbon cartridge according to claim 10, wherein said drive-transfer gear has three gears, the central one being in frictional contact with the raised circumference of said porous ink reservoir.

14. A ribbon cartridge according to one of claims 10 or 13 wherein said first and second brackets are forked and said forks have concave ends for receiving drive and transfer and idler gears respectively, between said forks.

15. A ribbon cartridge according to one of claims 9, 5, or 10 wherein the flexible ribbon guide is pivotally mounted on said ribbon cartridge housing.

* * * * *